US009241579B2

(12) United States Patent
Gandolfi

(10) Patent No.: US 9,241,579 B2
(45) Date of Patent: Jan. 26, 2016

(54) SUPPORT ELEMENT FOR BED RESTS, IN PARTICULAR WITH SLATS, AND BED REST PROVIDED WITH A PLURALITY OF SUPPORT ELEMENTS

(76) Inventor: Stefano Gandolfi, Verona (IT)

( * ) Notice: Subject to any disclaimer, the term of this patent is extended or adjusted under 35 U.S.C. 154(b) by 59 days.

(21) Appl. No.: 14/128,627

(22) PCT Filed: Jun. 21, 2012

(86) PCT No.: PCT/IT2012/000191

§ 371 (c)(1),
(2), (4) Date: May 28, 2014

(87) PCT Pub. No.: WO2012/176226

PCT Pub. Date: Dec. 27, 2012

(65) Prior Publication Data

US 2014/0283306 A1 Sep. 25, 2014

(30) Foreign Application Priority Data

Jun. 21, 2011 (IT) ..... VI2011A0164

(51) Int. Cl.
*A47C 23/06* (2006.01)

(52) U.S. Cl.
CPC ..... *A47C 23/063* (2013.01); *A47C 23/064* (2013.01)

(58) Field of Classification Search
CPC ..... A47C 23/06
USPC ..... 5/236.1, 238, 237, 191
See application file for complete search history.

(56) References Cited

U.S. PATENT DOCUMENTS 5,924,149 A * 7/1999 Weber ..... 5/238

* cited by examiner

*Primary Examiner* — Fredrick Conley
(74) *Attorney, Agent, or Firm* — Hedman & Costigan, P.C.; James V. Costigan; Kathleen A. Costigan

(57) ABSTRACT

The invention relates to a support element (11) for a bed rest, in particular with slats (12), comprising a central portion (13) with a mainly vertical extension, that is connected to the bed rest and that is provided with a free end (15), and an arc-shaped and elastically yielding portion (14), which is slidably connected to the free end (15) of the central portion (13); in particular, the free end (15) of the central portion (13) has a first seat (23) for housing a pulley or sliding guide (16) and the elastically yielding portion (14) has a second seat (25), for each side, for housing respective pulleys or sliding guides (18), motion transmitting elements (19) being also placed on the pulleys or sliding guides (16, 18). The invention further relates to a bed rest equipped with a plurality of the above mentioned support elements (11).

10 Claims, 5 Drawing Sheets

SUPPORT ELEMENT FOR BED RESTS, IN PARTICULAR WITH SLATS, AND BED REST PROVIDED WITH A PLURALITY OF SUPPORT ELEMENTS

The present invention relates to the interior design and describes a support element for a bed rest, in particular with slats, and a bed rest equipped with a plurality of said support elements.

The rhythm of our life, the sedentary work, the increasing lack of physical exercise lead us even more towards a new concept of comfort, due to new habits and needs.

In this regard, the bed, where we spend about a third of our life, has a particular importance and it is the object of the modern search for prosperity.

The upright position that distinguishes the human species has meant that, in the course of evolution, the vertebral column had a particular S-shaped conformation; said conformation that is optimal for the movement in an upright position, however, it is particularly vulnerable to painful conditions, such as back pain, lumbago, lumbar and cervical arthritis, herniated discs, etc.

In order to avoid said diseases, it is important to have bed rests that allow the vertebral column to maintain, even expanse, the same conformation which has in a standing position.

In fact, an incorrect position at rest prevents the total muscle relaxation by inhibiting or delaying the achievement of the deeper stages of sleep (REM) that are needed to regenerate our physical and mental balance and therefore our well-being.

Variable and individual factors, such as the body shape and the positions taken at rest, are the main elements to be considered in achieving an optimal bed rest, which evolves the quality of sleep and, consequently, the quality of life.

A bed rest of this type is described in the European Patent EP 1643883 B1, which relates to a bed rest with improved structure, comprising a plurality of slats, placed transversely to at least one portion of the bed frame and connected to said frame through a slat holder, on which a series of stems or pistons are provided, each stem being connected with one or more of said slats and associated with at least one respective elastic sliding element.

Each piston is fixed to a first pulley able to transmit the movement, by means of flexible elements, such as ropes, belts, chains and/or cables, that are connected to the bed frame, so that the pistons react to pressure exerted by the body lying on the bed rest, by offsetting the depressions created by the heaviest parts of the body, i.e. the parts of the body between the shoulder and the pelvis, with an upward thrust, supporting the lighter parts of the body, i.e. the back and the loins.

Said technical solution, therefore, has a plurality of different elements, such as pistons and springs, and other connection elements, which involve, disadvantageously, a very elaborate and expensive construction of the structure.

In addition, a second drawback is given by the interaction between the various parts constituting the system, which involves a continuous mechanical friction, which consequently determines an early wearing due to the continuous use.

Another drawback is given by the tricky maintenance of the system according to the above-mentioned patent, since, given the fact that the mechanical components are placed inside the bed frame, said components are not immediately available and/or removable; moreover, since a high number of mechanical elements is provided, there is the risk of losing at least one of them, once they are removed from the bed frame.

Finally, the presence of a plurality of elements increases the overall weight of the structure and also causes an increase of breakages and slight shifts of the elements, as well as problems related to the warehouse management, encumbrances, etc.

The object of the present invention is therefore to overcome the drawbacks of the prior art by making a support element for a bed rest, in particular a slatted bed rest, and a bed rest equipped with a plurality of said support elements, in a simple and economical way, which also allows an easy maintenance.

Another object of the present invention is to provide a support element for a bed rest, in particular with slats, and a relative bed rest equipped with a plurality of said support elements, which allow an orthopedically correct support of the vertebral column, thus achieving an active reaction of the bed rest to the anatomy of the lying body.

Another object of the present invention is to provide a support element for a bed rest, in particular a slatted bed rest, and a bed rest equipped with a plurality of said support elements, in which the aesthetics is integrated with a perfect system for sleeping, also able to guarantee a total relaxation of the body and a complete physiological healthy for the user.

Another object of the present invention is to provide a support element for a bed rest, in particular a slatted bed rest, and a bed rest equipped with a plurality of said support elements, which allow to obtain a perfect solution for rest and relaxation and to solve all the problems related to the sleep. A further object of the present invention is to provide a support element for a bed rest, in particular a slatted bed rest, and a bed rest equipped with a plurality of said support elements, which, depending on the different areas of pressure that our body exerts on the mattress as a function of individual factors, always guarantee a correct posture, thus planning a "tailor-made" sleep for each user.

Another object of the present invention is to provide a support element for a bed rest, in particular a slatted bed rest, and a bed rest equipped with a plurality of said support elements which are easy and cheap to manufacture, without using complex technologies or expensive components.

The above objects as well as other objects are achieved, in the present invention, by providing a support element for a bed rest, in particular a slatted bed rest, and a bed rest equipped with a plurality of said support elements, according to the enclosed claims 1 and 7.

Advantageously, the bed rest according to the present invention ensures a high quality of rest for each shape of body (long-limbed, rangy, obese, thin, etc.), for each weight and for each individual need, also according to the different positions assumed during the sleep (mainly prone, supine and lateral) that lead to several weight distributions of the laying body during the rest.

The support structure of the bed rest according to the present invention, in fact, allows the transverse slats to react actively to the weight exerted by the different anatomical areas of the lying body, with an upward thrust of equal intensity and equally distributed along the length of the bed rest, thus ensuring the total comfort of an orthopedically correct support of the vertebral column and also ensuring a total relaxation of the muscular system, the maintenance of the right temperature of the body and adequate sanitary conditions safeguarding by mites, bacteria, mold and powders.

The bed rest may be available in both fixed and articulated version and it may have a manually or electrically (even with a remote-control) tilt adjustment, so as to be the ideal solution for sleeping, for relaxing and also for reading, thanks to the possibility of adjusting the tilt of the bed rest.

The flexible slats elastically react to the loads of the lying body and they yield only where it is necessary, thus preventing dips of the body and allowing the vertebral column to assume a physiologically correct position, the muscular system to relax, the mattress to transpire thus always ensuring the sleep in perfect hygienic conditions and in an ideal microclimate.

Therefore, the bed rest is adjusted on the body, regardless of the weight and of the positions taken by the body during the sleep, thus giving an intense feeling of well being, similar to the total relaxation which is obtained when the body floats on the water; moreover, if the slats are not contained in a perimeter frame, they are equally flexible both at the center and at the ends, thus guaranteeing a remarkable comfort for the user.

Furthermore, the main element of the structure of the bed rest according to the invention can be made with a single mould and in a substantially cheap material, which allows to drastically reduce the production costs of the whole bed rest.

The technical features and the advantages of the support element for bed rests, according to the present invention, will become apparent from the following description, related to a preferred embodiment of the invention, with reference to the enclosed schematic drawings, in which.

Figure 1:
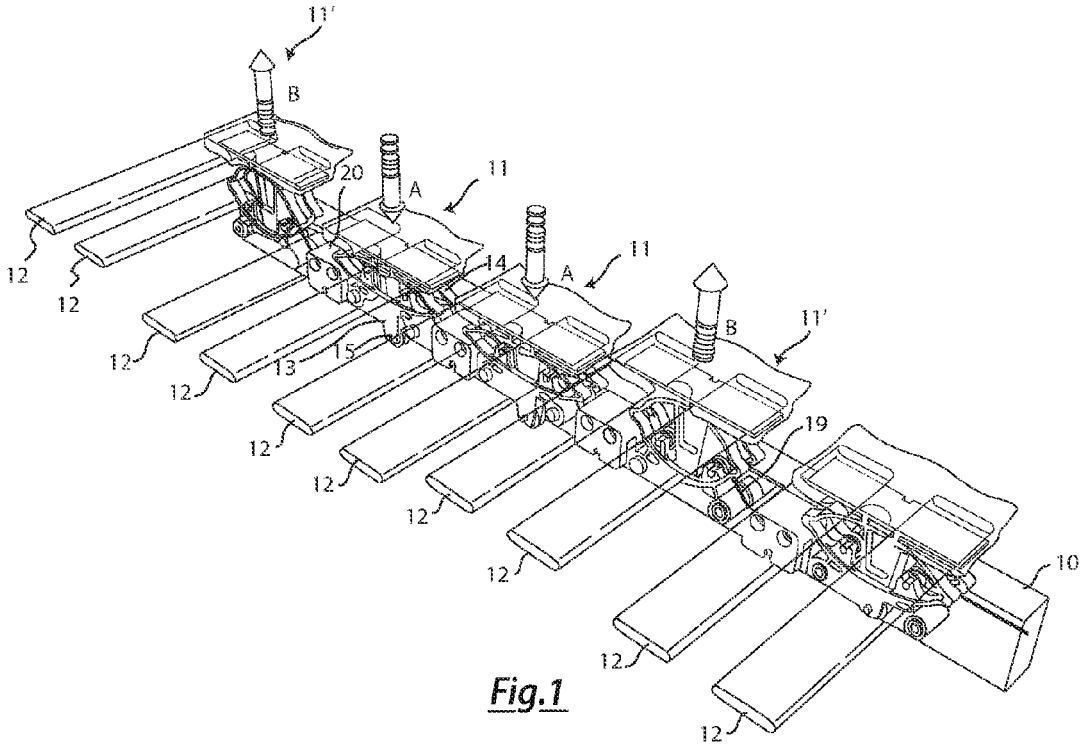
FIG. 1 is a schematic perspective view of a portion of the bed rest with improved structure, according to the invention, when the load of a lying body is placed on the bed rest.
Figure 2:
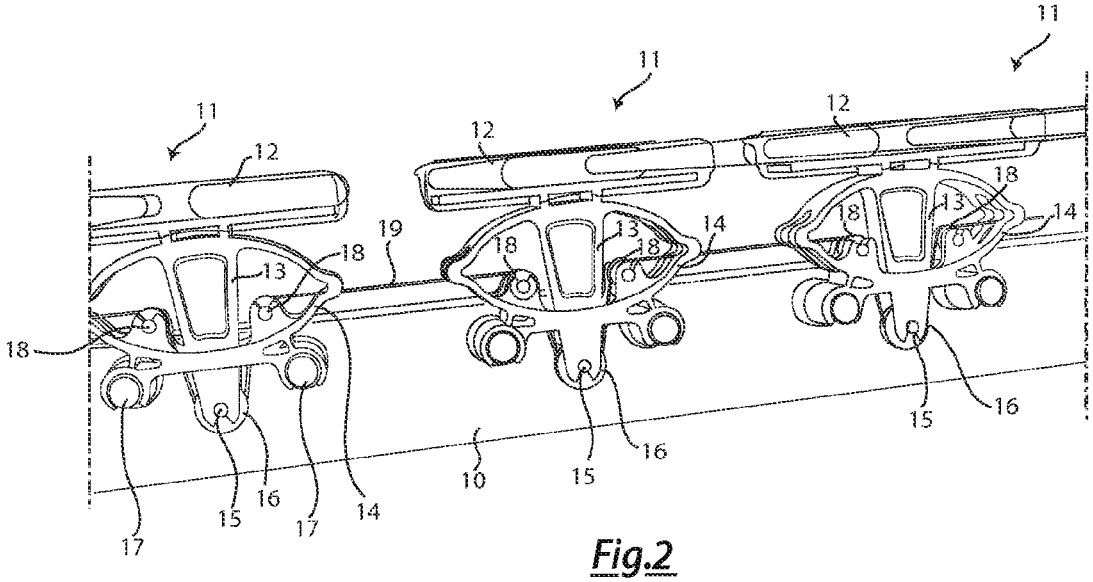
FIG. 2 is a schematic side view of a portion of the bed rest with improved structure according to a first embodiment of the invention.

The structure of the bed rest, which is the object of the present invention, comprises a frame, generically indicated with 10 in the figures, consisting of a central supporting body, on which a plurality of elements 11 are fixed; a pair of slats 12 is connected, through tilting slat-holders or joints, at the top of each element 11 and the slats 12 are placed transversely to the bed rest and usually constitute the support of a mattress (not shown).

With reference to the above mentioned figures, each element 11 has a respective central portion 13, which is substantially vertical and which is rigidly connected to the pair of slats 12.

Furthermore, each central portion 13 is associated with an arc shaped and elastically yielding portion 14, which is positioned between the pair of slats 12, to which is rigidly connected, and the end 15, opposed to the slats 12, of the central portion 13, to which is slidably connected.

In other words, as shown in FIG. 1, following a vertical pressure along the direction of the arrow A, the central portion 13 of the element 11 is free to move downwards, together with the connected pair of slats 12, while the lower end 15 passes through the lower part of the elastically yielding portion 14 of the element 11.

The end 15 of each central portion 13 is connected to a respective pulley or sliding guide 16 for transmitting the movement.

Two pins 17 are provided at the sides of the central portion 13, through which the element 11 is fixed to the frame 10, while further pulleys or sliding guides 18 are provided above the pins 17 for transmitting the movement.

Each pulley or sliding guide 16, 18 is used to transmit the translation movement by means of flexible elements, generically indicated with 19 in the figures, such as belts, ropes, chains or cables.

Figure 3:
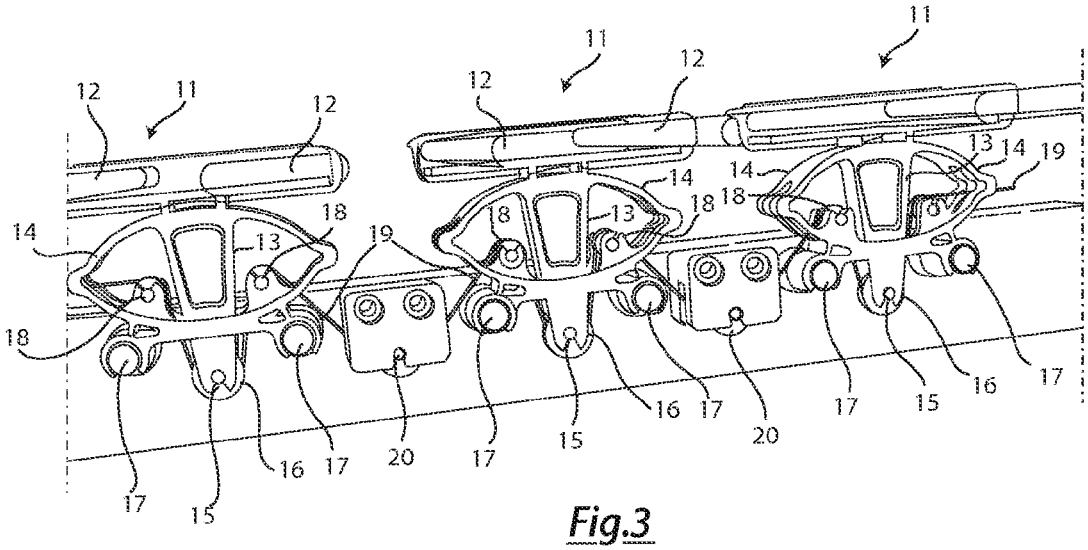
FIG. 3 is a schematic side view of a portion of the bed rest with improved structure according to a second embodiment of the invention.

In a further preferred embodiment, shown in FIG. 3, additional sliding and guiding elements 20, able to transmit the movement, are fixed to the frame 10 and are arranged at a predetermined distance between the elements 11.

Moreover, the elements 11 may be connected together in one, two or more files, that are arranged laterally or centrally to the bed frame 10, while the slats 12 are aligned and are slidably fixed to the ends of the bed rest, through known devices.

Moreover, the elements 11 may be arranged on the whole bed frame 10 or exclusively in correspondence of a prefixed portion or zone of the frame 10; for example, the elements 11 may be arranged in a central portion of the bed rest corresponding to a region of the mattress supporting the vertebral column, where, usually, in the prone, supine or side positions, parts of the body between the shoulders and the pelvis rest.

Finally, each element 11 has a vertical excursion, which enables the bed rest to adapt to the body's anatomy, so as to receive the most heavy and bulky parts of the body, such as the shoulders and the pelvis, and to hold strongly the parts of the body which require more support, such as the lumbar zone, regardless of the weight and the conformation of the lying body; this occurs thanks to the principle of pressure equalization, so that the lowering of one or more slats or portions of them corresponds to the lifting of other slats of the bed rest.

Thus, the bed rest and the mattress actively interact with each other, adapting to each other and ensuring the full compliance with the prefixed purposes.

It is clear, for example, from the enclosed FIG. 1 that, according to the well known principle of pressure equalization which in this case takes place by means of a non-elastic tensioned cable, the elements 11 and 11' react to the pressures exerted by the body lying on the bed rest, so as to offset the dips of the bed rest created by the heaviest parts of the body (in the direction of arrow A), with an upward thrust (in the direction of arrow B) which is supplied to the adjacent elements 11', in order to support the parts more slight of the lying body.

In fact, the downward thrust (arrows A) of a certain number of elements 11 (relating to a particular portion of the bed rest) necessarily corresponds to a thrust in the opposite direction (arrows B) of the other elements 11', thanks to the transmission of the movement through the belt 19 and the pulleys or sliding guides 16, 18 and thanks to the compression of the elastically yieldable portions 14 of the elements 11 fixed to the bed frame 10.

The same happens in the same way and in any combination of the structure when the elements 11 previously raised are lowered, thanks to the movement of the respective elastically yielding portions 14, so as to obtain the corresponding lifting of the respective other elements 11 in other areas of the bed rest.

This allows an absolute adaptability to the shape and anatomy of the vertebral column, because the structure of the invention allows to receive the heavier and bulky parts of the lying body, such as the shoulders and the pelvis, and allows the vertebral column to maintain its natural structure even when it is relaxed, regardless of the weight of the lying body and of the rest position; the structure of the invention also uses a mechanical system which is extremely simple and greatly cheap, as well as safe, practical and reliable.

Figure 4:
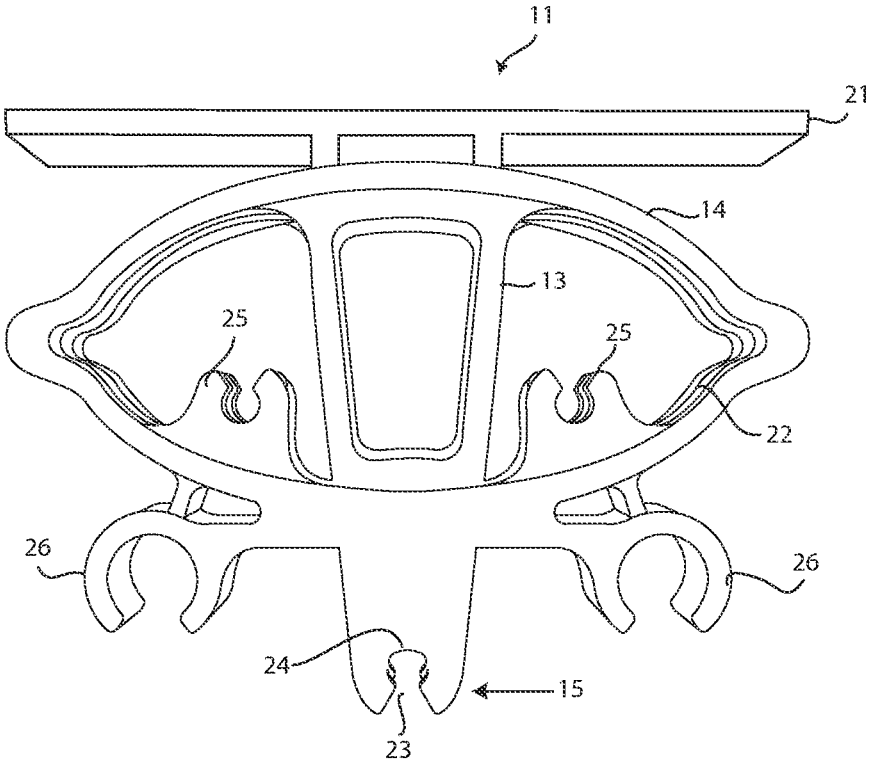
FIG. 4 is an enlarged front view of a technical element of the bed rest with improved structure according to the present invention.
Figure 5:
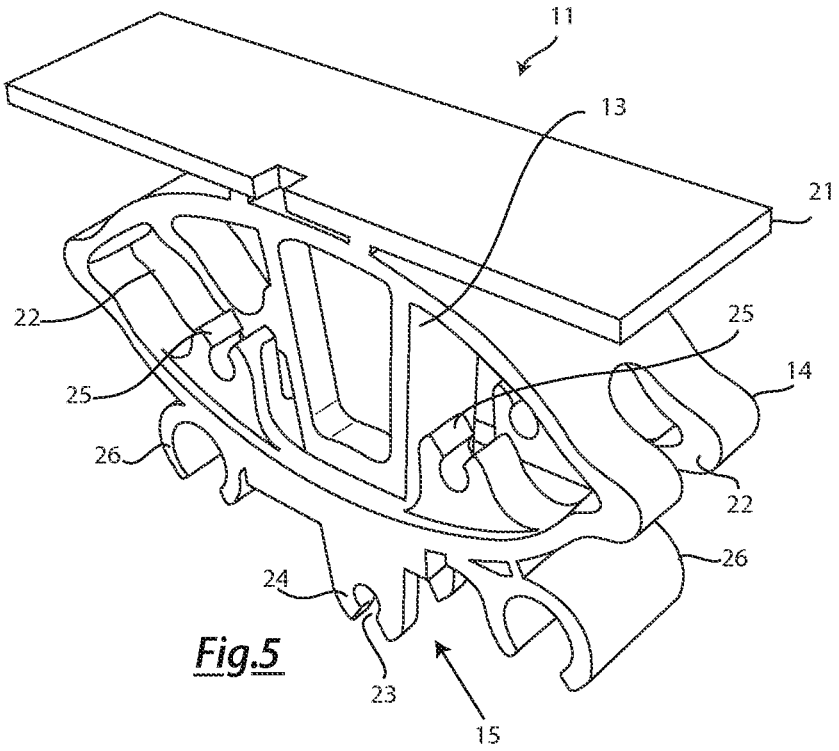
FIG. 5 is a perspective view of the element shown in FIG. 4.

In fact, as shown in FIG. 4, the element 11 is constituted by a single piece, comprising a support 21 for the slats (not shown in this figure), which is integral with the central portion 13, substantially trapezoidal and sliding in a vertical direction, the upper part of the portion 14 being arc-shaped and elastically yielding.

Said portion 14 is substantially arc-shaped or elliptical and has a thickness greater than the central portion 13 and is provided, in its lower part, with a longitudinal slot 22, inside which the central portion 13 is inserted.

A seat 23, which is provided at the end 15 of the central portion of the element 11, has a substantially circular tip 24 where a first pulley is inserted, while other seats 25 are formed along the perimeter of the arc-shaped portion where other sliding pulleys for the movement of the belt or cable 19 are housed.

The seats or recesses 26, opposite to the seats 25, are able to house the pins 17 used for fixing the frame 10.

Furthermore, the above mentioned support element can be advantageously manufactured by a single mould and with a relative inexpensive material, such as plastic; finally, in preferred, but not limiting, embodiments of the invention, it is possible to have a mould shaped with sliding guides and pins, which can be directly fixed to the bed frame.

Alternatively, the central portion 13 and the arc-shaped elastically yielding portion 14 may be constituted by two distinct elements, as previously mentioned, as well as the arc-shaped elastic portion 14, for reasons of molding technique and performance of the materials, can be made in two symmetric and mirrored portions.

From the above description the characteristics of the support element for bed rests and of the bed rest thus formed, which are the object of the present invention, are clear, as well as their advantages.

In particular, the advantages are the following:

"active" support for vertebral column;

good "comfort" for the user;

good ventilation;

lightweight structure;

low costs and several advantages.

It is clear, finally, that numerous other variants can be made to the support element for bed rests and to the bed rest of the invention, without departing from the novelty principles inherent in the inventive idea, as well as it is clear that, in practice implementation of the invention, the materials, forms and dimensions of the shown elements may be any according to the requirements and that they can be replaced with other technically equivalent elements.

For example, the belt 19 can be advantageously replaced with a non-elastic tensioned cable, made of any material and adapted to transmit the movement between the pulleys.

The invention claimed is:

1. Support element (11) for bed rests having slats (12), said support element comprising a central portion (13) with a vertical section and a free end (15) having a first seat (23) connected to at least one first pulley or sliding guide (16), and an elastically yielding portion (14), having an arc shaped upper portion and a lower portion having a longitudinal slot (22), which is slidably connected to said central portion (13) which is downwardly moveable through said longitudinal slot (22), wherein said elastically yielding portion (14), has at least one second seat (25) on each side for housing respective second and third pulleys or sliding guides (18), and movement transmitting elements (19) being placed on said first pulley or sliding guide (16), second and third-pulleys or sliding guides (18).

2. Support element (11) according to claim 1, characterized in that said elastically yielding portion (14), having an arc shaped upper portion and a lower portion having a longitudinal slot (22), has a substantially curved or elliptical shape.

3. Support element (11) according to claim 1, characterized in that said support element (11) has at least one slat support (21), where a plurality of slats (12) are inserted, which is integral with said central portion (13) and with at least one part of said elastically yielding portion (14), having an arc shaped upper portion and a lower portion having a longitudinal slot (22).

4. Support element (11) according to claim 1, characterized in that said support element (11) has shaped portions (26) adapted to receive elements (17) for fixing said support element (11) to a bed frame (10).

5. Support element (11) according to claim 1, characterised in that said support element (11) is made in a single piece which comprises said slat support (21), said slat support (21) being integral with said central portion (13) and with said elastically yielding portion (14), having an arc shaped upper portion and a lower portion having a longitudinal slot (22).

6. Support element (11) according to claim 1, characterised in that said elastically yielding portion (14), having an arc shaped upper portion and a lower portion having a longitudinal slot (22), is formed by two symmetric and mirrored portions.

7. Bed rest comprising a frame (10) and provided with a plurality of support elements according to claim 1, said support elements being fixed to at least one area of said frame (10) by means of fixing elements (17).

8. Bed rest according to claim 7, characterized in that it provides further pulleys and/or sliding elements (20) for transmitting movement, which are fixed to said frame (10) and which are placed between two support elements (11).

9. Bed rest according to claim 8, characterized in that said support elements (11) are connected to each other in one, two or more rows, which are placed laterally or centrally with respect to said frame (10) of the bed rest.

10. Bed rest according to claim 7, characterized in that said support elements (11) are connected to each other in one, two or more rows, which are placed laterally or centrally with respect to said frame (10) of the bed rest.

* * * * *